United States Patent [19]

Heitmann et al.

[11] Patent Number: 4,661,206

[45] **Date of Patent: * Apr. 28, 1987**

[54] WET PRESS FOR DEWATERING A MATERIAL WEB WITH PLURAL PRESSURE POCKETS AND UNSYMMETRICAL ARRANGEMENT

[75] Inventors: Peter Heitmann, Bad Schussenried; Herbert Holik, Ravensburg; Peter Mirsberger, Berg, all of Fed. Rep. of Germany

[73] Assignee: Sulzer-Escher Wyss GmbH, Ravensburg, Fed. Rep. of Germany

[ * ] Notice: The portion of the term of this patent subsequent to Dec. 3, 2002 has been disclaimed.

[21] Appl. No.: 695,854

[22] Filed: Jan. 28, 1985

[30] Foreign Application Priority Data

Feb. 6, 1984 [CH] Switzerland ..... 534/84

[51] Int. Cl.[4] ..... D21F 3/02

[52] U.S. Cl. ..... 162/358; 29/116 AD; 100/118; 100/153; 162/361

[58] Field of Search ..... 162/358, 360.1, 361, 162/205, 305; 29/113 AD, 116 AD; 100/118, 153, 154, 162 B

[56] References Cited

U.S. PATENT DOCUMENTS

| | | | |
|---|---|---|---|
| 3,783,097 | 1/1974 | Justus | 162/358 |
| 3,802,044 | 4/1974 | Spillmann et al. | 29/113 AD |
| 3,970,515 | 7/1976 | Busker | 162/205 |
| 3,974,026 | 8/1976 | Emson et al. | 162/358 |
| 4,228,571 | 10/1980 | Biondetti | 29/116 AD |
| 4,427,492 | 1/1984 | Cronin | 162/358 |

FOREIGN PATENT DOCUMENTS

| | | | |
|---|---|---|---|
| 1172887 | 8/1984 | Canada | 162/358 |
| 107607 | 4/1984 | European Pat. Off. | 162/358 |
| 3224007 | 12/1983 | Fed. Rep. of Germany | 162/358 |
| 79919 | 2/1971 | German Democratic Rep. | 162/358 |

*Primary Examiner*—S. Leon Bashore
*Assistant Examiner*—K. M. Hastings
*Attorney, Agent, or Firm*—Werner W. Kleeman

[57] ABSTRACT

In a wet press for dewatering a web of material, for instance a paper web, a contact pressure device is provided which presses against a rotating roll and exerts an incrementally increasing pressure in the direction of travel of the paper web. The contact pressure device comprises only a single pressure element arranged in the direction of travel of the paper web. The pressure element has two or more pressure pockets arranged sequentially in the direction of web travel and which are connected with a common pressure chamber by conduits. The increasing contact pressure is attained by arranging the pressure element unsymmetrically in relation to the pressure chamber. The effective pressure cross-sectional areas of pressure pockets arranged sequentially in the direction of web travel can additionally be reduced in the direction of web travel or the cross-sections of the associated bores can be increased.

13 Claims, 7 Drawing Figures

WET PRESS FOR DEWATERING A MATERIAL WEB WITH PLURAL PRESSURE POCKETS AND UNSYMMETRICAL ARRANGEMENT

CROSS REFERENCE TO A RELATED APPLICATION

This application is related to the commonly assigned U.S. patent application Ser. No. 695,853, filed Jan. 28, 1985, and entitled "WET PRESS FOR DEWATERING A WEB OF MATERIAL".

BACKGROUND OF THE INVENTION

The present invention broadly relates to a wet press and, more specifically, pertains to a new and improved construction of a wet press for dewatering a web of material.

Generally speaking, the wet press of the present invention comprises a rotating or rotatable roll and a contact pressure device. The web of material is guided between the rotating or rotatable roll and the contact pressure device in a press nip conjointly with at least one water-absorbent belt along a portion of the circumference of the rotating or rotatable roll. The contact pressure device comprises a hydrostatic pressure element. The hydrostatic pressure element comprises a support shoe movable in the pressing direction. The support shoe comprises at least two pressure pockets or recesses sequentially arranged in the direction of travel of the web of material in the press nip. The pressure pockets are connected with a common pressure chamber by conduits. The common pressure chamber is supplied with a suitable pressure medium.

In other words, the wet press of the present invention for dewatering a web of material comprises a rotatable roll and a contact pressure device, the contact pressure device and the rotatable roll defining therebetween a press nip. The wet press also comprises at least one water-absorbent belt, the web of material being guided conjointly with the water-absorbent belt through the press nip between the contact pressure device and the rotating roll and along a portion of the circumference of the rotatable roll. The web of material has a predetermined direction of travel. The contact pressure device comprises a hydrostatic pressure element having a predetermined direction of pressing. The hydrostatic pressure element comprises a support shoe movable in the predetermined direction of pressing. The support shoe comprises at least two pressure pockets arranged sequentially in the direction of travel of the web of material in the press nip, a common pressure chamber supplied with a suitable pressure medium and conduits connecting the pressure pockets with the common pressure chamber.

Such wet presses are disclosed, for example, in the German Pat. No. 2,313,920, and serve for dewatering, for instance, a paper web or pulp web or another fibrous material. The web of material is guided through a press nip conjointly with, for instance, a water-absorbent felt belt and a water-impervious contact pressure belt. The press nip is formed by a roll and a hydrostatic pressure element. In this manner, a uniform contact pressure is attained in the press nip over a certain length of the web of material in the direction of travel, so that the dewatering of the web of material to be expressed is significantly better than in wet presses having two rolls acting only in one line transverse to the web of material. The dewatering performance is, however, not optimal since the contact pressure or pressing force in the press nip remains practically constant over the entire length.

It is known to the art, for instance from the German Pat. No. 3,105,276, or the U.S. Pat. No. 3,783,097, granted Jan. 1, 1974, to provide a successively increasing contact pressure or pressing force in a press nip of predetermined length in a wet press having a roll and a contact pressure device cooperating with the roll. This effect is attained in such wet presses by arranging a plurality of pressure chambers or a plurality of hydraulically actuatable bearing shoes sequentially in the direction of web travel. For attaining a contact pressure or pressing force increasing in the direction of web travel, the individual pressure chambers or bearing shoes arranged sequentially must be supplied with a suitable pressure medium at a different and successively increasing pressure. This, however, requires a complicated regulation of the pressure in the individual pressure chambers and a multiplicity of control devices and control conduits. Furthermore, a plurality of independent bearing elements are necessary in the direction of web travel which complicates construction to an undesirable degree. Furthermore, a pressure drop arises between the bearing shoes which leads to an undesirable re-moistening of the web of material.

SUMMARY OF THE INVENTION

Therefore, with the foregoing in mind, it is a primary object of the present invention to provide a new and improved construction of a wet press which does not exhibit the aforementioned drawbacks and shortcomings of the prior art constructions.

Another and more specific object of the present invention aims at providing a new and improved construction of a wet press of the previously mentioned type in which an improved dewatering of a web of material is attainable without requiring a complicated regulation of a plurality of pressure elements and while avoiding a multiplicity of such pressure elements in the direction of web travel, nevertheless, a dewatering with successively increasing or incrementing contact pressure or pressing force and minimal remoistening with as little equipment expense as possible is attained.

Yet a further significant object of the present invention aims at providing a new and improved construction of a wet press of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the wet press for dewatering a web of material of the present invention is manifested by the features that the contact pressure device comprises a piston containing a support shoe and movable in relation to the pressure chamber and arranged unsymmetrically in relation to the support shoe such that the area of the pressure pockets before the central axis, as seen in the predetermined direction of travel of the web of material, is greater than is the area of the pressure pockets behind the central axis of the piston.

In other words, the wet press of the present invention is manifested by the features that the contact pressure device comprises a piston containing a support shoe and movable relative to the pressure chamber, the pressure pockets define a total pressure area coming into contact with the web, the piston has a central axis, and the piston is arranged unsymmetrically in relation to the support shoe such that a first portion of the total pressure area which comes into contact with the web which lies before the central axis, as seen in the direction of web travel, is greater than a second portion of the total pressure area which comes into contact with the web which lies behind the central axis as seen in the direction of web travel.

It is particularly advantageous for the cross-sections of the pressure pockets arranged sequentially in the direction of travel of the web of material to have a decreasing effective pressure area or for the associated conduits to have an increasing cross-section or both.

The invention exploits the recognition that differing pressures arise in the pressure pockets in operation due to the unsymmetrical geometric construction of the pressure element, especially the asymmetric arrangement of the piston, augmented by the differing construction of the pressure pockets and conduits, and also due to the tendency of the pressure element to counteract a tipping or rocking moment, even though all pressure pockets are interconnected by the conduits communicating with the same pressure chamber.

It is particularly advantageous to select the asymmetry of the piston, the effective pressure areas of the pressure pockets and the cross-section of the conduits for the pressure pockets provided in the common support shoe, as well as to proportion them in relation to one another, such that the gap arising in operation between the surface of the pressure elements and the counter surface defined by the coacting rotatable roll is approximately constant over the entire periphery of the common support shoe. If, for instance, a larger gap arises at the inlet side than on the outlet side of the pressure element, then the cross-section of the conduit of the inlet side pressure pocket can be reduced to such an extent that an equally large gap arises on both sides.

In this manner it is possible to construct the pressure elements so unsymmetrically in the direction of travel of the web of material and to choose the asymmetry of the piston relative to the pressure pockets such that the resultant pressing force is effective approximately at the mid-point of the piston.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
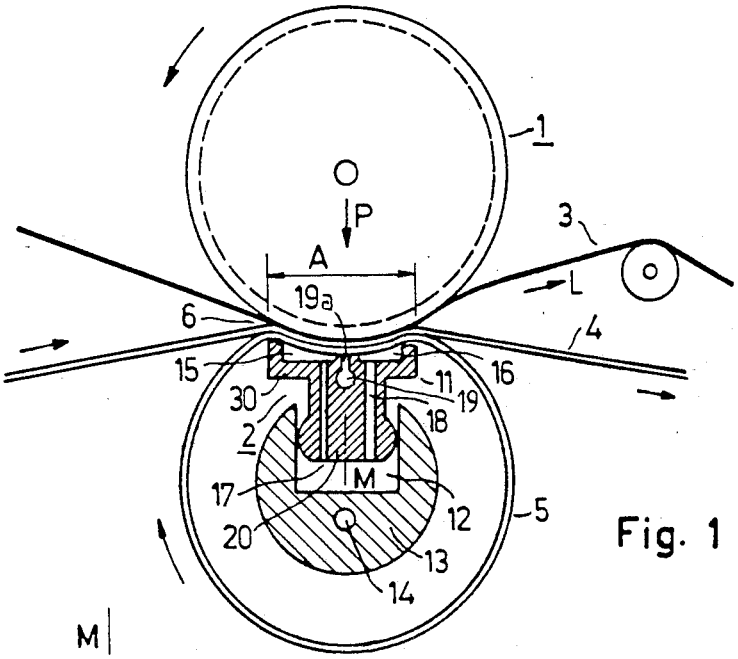
FIG. 1 schematically shows a wet press according to this invention containing a first contact pressure device in longitudinal section.

Describing now the drawings, it is to be understood that to simplify the showing thereof only enough of the structure of the wet press for dewatering a web of material has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a rotating or rotatable roll 1 and a contact pressure device 2, between which the web of material, for instance a paper web 3, is guided conjointly with a water-absorbent belt 4, for instance a felt belt, and a flexible water-impervious shell or jacket 5 through a press nip 6 along a portion A of the circumference of the rotatable roll 1. During the passage of the paper web 3 through this press nip 6, the dewatering of the paper web 3 occurs with successively increasing contact pressure or pressing force. The water expressed from the paper web 3 is absorbed by the felt belt 4. If necessary, further belts, for instance a sieve belt, can be additionally guided through the press nip 6.

The rotating or rotatable roll 1 can be constructed as a solid roll, as a tubular roll or as a suction roll. This roll 1 can also be constructed as a controlled deflection roll or sag compensation roll such as is, for example, disclosed in the U.S. Pat. No. 3,802,044, granted Apr. 9, 1974, or as a relatively flexible belt-shaped roll shell or jacket suitably supported in the interior.

The water-impervious shell or jacket 5 can be constructed as a flexible roll shell or jacket without guide rolls or as a continuous rubber belt which, if necessary, is guided over a plurality of guide rolls 8, 9 and 10. In any case, sufficient flexibility and adaptability to the surface of the roll 1 in the press nip 6 must be ensured.

The contact pressure device 2 comprises one or more hydrostatic pressure support elements 11 arranged adjacently in a direction extending substantially transverse to the direction of web travel and which, for instance, can be constructed analogously to the disclosure of the aforementioned U.S. Pat. No. 3,802,044. The pistons 20 of these pressure elements are movable in the pressing direction P in substantially cylindrical or groove-shaped pressure chambers 12 of a transverse roll support or beam 13 and are inclinable in relation to the pressing direction P to a certain degree, so that support shoes 30 of the pressure elements 11 are adaptable to a counter surface, i.e. the roll surface of the rotatable roll 1. The pressure chamber 12 is connected to a conduit 14 and is supplied through this conduit 14 with a suitable pressure medium, for instance oil or water, having a predetermined pressure. The support shoes 30 of the pressure elements 11 comprise a plurality of bearing or pressure pockets or recesses on their pressing surface, for instance two bearing or pressure pockets or recesses 15 and 16 arranged sequentially in the direction of travel L of the web of material 3. The effective pressure area of the inlet side bearing or pressure pocket or recess 15 can, for instance, be greater than the effective pressure area of the outlet side bearing or pressure pocket 16. Both pressure pockets or recesses 15 and 16 are connected with the common pressure chamber 12 through suitable conduits. The inlet side pressure pocket or recess 15 is connected with the common pressure chamber 12 by a conduit 17 of small cross-section and the outlet side pressure pocket or recess 16 by a conduit 18 of larger cross-section.

The piston 20 of the pressure element 11 is arranged unsymmetrically in relation to the support shoe 30 supported by this piston 20 such that the effective pressure area lying before the central axis M of the piston 20 as seen in the direction of web travel L, i.e. substantially the pressure area of the pressure pocket or recess 15, is greater than the effective pressure area lying behind or beyond the central axis M of the piston 20, i.e. substantially the pressure area of the pressure pocket or recess 16.

The construction of the pressure elements 11 described above permits the arisal of a higher pressure in the pressure pocket or recess 16 in operation than in the pressure pocket or recess 15, even though both pressure pockets or recesses 15 and 16 are in communication with the common pressure chamber 12, so that an improved dewatering of the paper web 3 under successively increasing contact pressure or pressing force is made possible. Only a single contact pressure element 11 is necessary in the direction of web travel L and no separate regulation devices for the pressure pockets or recesses 11 arranged sequentially in the direction of web travel L are necessary. A contact pressure or pressing force successively increasing in the direction of web travel L arises automatically in the unsymmetrical pressure elements 11 described.

In general, when the contact pressure element 11 is constructed asymmetrically, the gap arising along the periphery of the pressing area between the pressing surface of the contact pressure element 11 and the counter surface will be of different size, i.e. the gap will have different values on the inlet and outlet sides. The size of this gap usually evolves such that the quantity of pressure medium escaping from the pressure pockets or recesses 15 and 16 through the gap corresponds to the quantity of pressure medium supplied from the pressure chamber 12 through the conduits 17 and 18 into the pressure pockets or recesses 15 and 16.

A change of the cross-section of the conduits 17 and 18 can therefore vary the size of the inlet side, respectively outlet side, gap and adjust it to a desired value. As a rule, the cross-sections of the conduits 17 and 18 will be adapted to the geometry of the pressure pockets or recesses 15, respectively 16, such that the gap is uniform along the entire periphery of the pressing area of the contact pressure element 11. Such an adaptation of the conduits 17 and 18 to the associated pressure pockets or recesses 15 and 16, respectively, can be effected either by calculation or by observing the practically arising gap widths and undertaking the corresponding modifications of the conduit cross-sections.

The pressure medium escapes from the pressure pockets or recesses 15 and 16 not only in the outer region but there is also a tendency for the pressure medium to transfer from the pressure pocket or recess 16 of higher pressure into the pressure pocket or recess 15 of lower pressure, since a pressure differential is established between the two pressure pockets or recesses 15 and 16. To eliminate or minimize this effect, slits 19*a* can be provided upon the pressing surface of the contact pressure element 11 between the pressure pockets or recesses 15 and 16 and which are in communication with a pressure medium drain conduit 19.

Due to the asymmetrical construction of the contact pressure elements 11 and the unsymmetrical arrangement of the piston 20 in relation to the support shoe 30, a pressure differential arises between the pressure pockets or recesses 15 and 16 of the support shoe 30 such that the resultant pressing force of the pressure pockets or recesses 15 and 16 is effective approximately in the piston center line M and a tipping or rocking moment is avoided.

It will be understood that a plurality of capillaries can also be provided for each of the pressure pockets or recesses 15 and 16 instead of a single connecting conduit 17 or 18 flow communicating with the pressure chamber 12. The cross-section determinant for the desired effect corresponds in this case to the sum of the cross-sections of the individual capillaries for the corresponding pressure pocket or recess 15 or 16.

Figure 2:
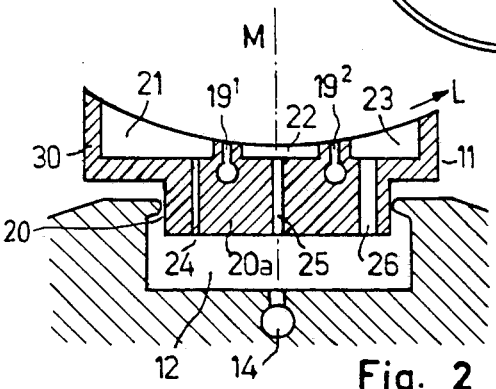
FIG. 2 schematically shows a second contact pressure device in longitudinal section.

As shown in FIG. 2, the contact pressure element 11 may also comprise more than two pressure pockets or recesses 15 and 16 arranged sequentially in the direction of web travel L, for instance three pressure pockets or recesses 21, 22 and 23 with successively increasing pressure. The effective pressure area in the three pressure pockets or recesses 21, 22 and 23 successively decreases in the direction of web travel L. The three pressure pockets or recesses 21, 22 and 23 are connected with the common pressure chamber 12 by conduits 24, 25 and 26, respective1y, whose cross-sections successively increase in the direction of web travel L. In this case, too, the supporting area of the support shoe 30 is again unsymmetrically constructed and arranged in relation to the central axis M of the piston 20.

Figure 3:
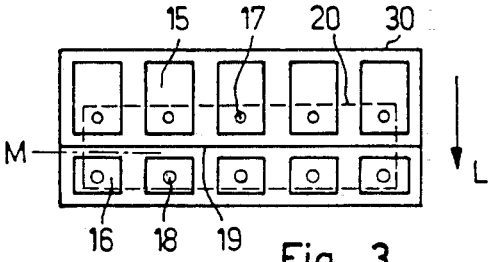
FIG. 3 schematically shows a third contact pressure device in plan view.

FIG. 3 shows the pressing surface of a contact pressure device 11 in plan view. A predetermined number of pressure pockets or recesses 15 and 16 are arranged adjacent to one another in two rows extending in a direction substantially transverse to the direction of web travel L. The piston ledge or beam 20*a* defined by the piston 20 is arranged unsymmetrically in relation to the effective pressure area. The effective pressure area of the inlet side pressure pockets or recesses 15 is greater than the effective pressure area of the outlet side pressure pockets or recesses 16 and the cross-section of the associated conduits 17 of the inlet side pressure pockets or recesses 15 is smaller than that of the conduits 18 of the outlet side pressure pockets or recesses 16.

Figure 4:
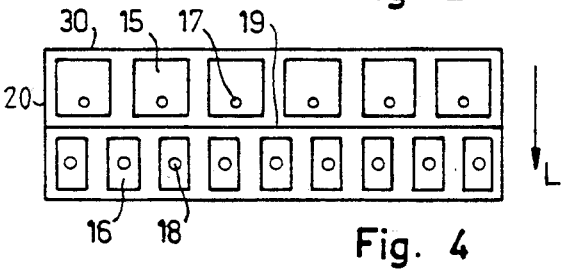
FIG. 4 shows a fourth contact pressure device in plan view.

As shown in FIG. 4, the number of pressure pockets or recesses 15 and 16 can be different in each of the rows, for instance the inlet side pressure pockets or recesses 15 can be constructed transversely wider than the outlet side pressure pockets or recesses 16 as illustrated. It is only important that the pressure pockets or recesses 15 and 16 display the previously described asymmetry in relation to the piston 20.

As shown in FIG. 4, the contact pressure device can also comprise a plurality of individual pressure elements $27^1 \ldots 27^5$ arranged adjacent to one another in a direction extending substantially transverse to the direction of web travel L instead of a ledge or beam-type pressure element 11 extending continuously over the entire width of the paper web 3 with pressure pockets or recesses 15 and 16 arranged adjacent to one another in several rows. If the pressing surfaces or effective pressure areas of the pressure elements 11 are constructed as squares or rectangles, as is usually the case, difficulties arise in that gaps or interstices necessarily exist between the individual pressure elements 11 which cause a pressure drop between the individual pressure elements 11. Such a pressure drop necessarily arises at the borders between two neighboring pressure 11 elements even when such pressure elements 11 are packed as closely as possible to one another over the width of the piston 20. This leads to a non-uniform dewatering over the width of the web of material 3 and, for instance, to an undesirable stripedness of the paper fabricated.

Figure 5:
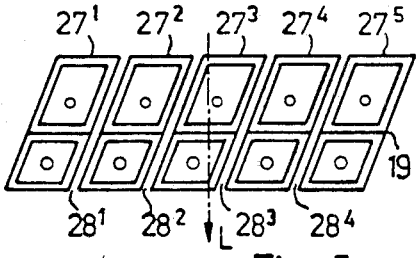
FIG. 5 schematically shows in plan view a contact pressure device having a plurality of pressure elements.

In order to avoid this effect, it is advantageous to arrange the gaps $28^1 \ldots 28^4$ between the individual pressure elements $27^1 \ldots 27^5$ in a direction deviating from the direction of travel L of the paper web 3. In the embodiment shown in FIG. 5, the gaps $28^1 \ldots 28^4$ extend at an acute angle, i.e. diagonally, to the direction of web travel L. The pressing surfaces or effective pressure areas of the individual pressure elements $27^1 \ldots 27^5$ are constructed as parallelograms. Naturally another form can also be provided. It must also be ensured that the gaps not extend continuously parallel to the direction of web travel L. In this manner, the effect is obtained that all zones extending transverse to the paper web 3 are treated with a sufficient pressing force and sufficiently dewatered, which avoids a stripedness of the fabricated paper or other processed web material.

Figure 6:
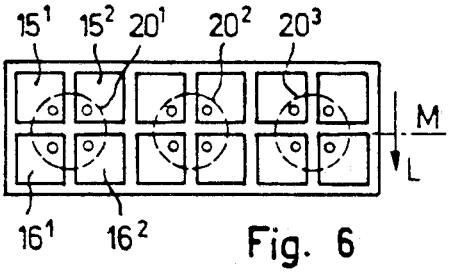
FIG. 6 schematically shows a contact pressure device having a plurality of pistons.
Figure 7:
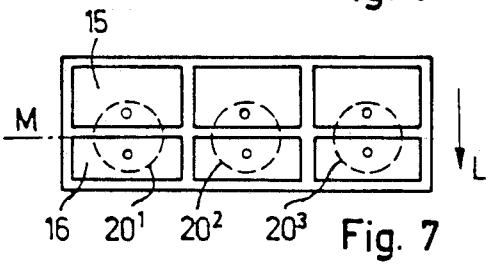
FIG. 7 schematically shows a further contact pressure device having a plurality of pistons.

As shown in FIGS. 6 and 7, the contact pressure device 2 can comprise a support shoe 30 constructed as a continuous ledge or beam which is supported by a plurality of separate pistons $20^1$, $20^2$ and $20^3$, each associated with a plurality of pressure pockets or recesses, e.g. four pressure pockets or recesses $15^1$, $15^2$, $16^1$ and $16^2$ in FIG. 6, having equal effective pressure areas, or as shown in FIG. 7 two different1y sized pressure pockets or recesses 15 and 16, instead of a piston ledge or beam. In this case too, the pressure pockets or recesses are arranged unsymmetrically in relation to the middle or central axis M of the piston, so that also in this case a successively increasing pressing force is obtained.

It will be understood that variations within the framework and teachings of the inventive concept are possible. While the piston is fixedly connected to the support shoe and is conjointly movable therewith in a stationary pressure chamber in the above-described embodiments, the piston can also be stationary and connected with the transverse support or beam while the pressure chamber is provided in the form of a cap on the rear side of the support shoe and is movable in relation to the piston.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A wet press for dewatering a web of material, comprising:

a rotatable roll having a circumference;

a contact pressure device;

said contact pressure device and said rotatable roll defining a press nip therebetween;

at least one water-absorbent belt;

the web of material being guided conjointly with said at least one water-absorbent belt between said contact pressure device and said rotatable roll through said press nip and along a portion of said circumference of said rotatable roll;

the web of material having a predetermined direction of travel;

said contact pressure device comprising a hydrostatic pressure element having a predetermined direction or pressing;

said hydrostatic pressure element comprising a support shoe movable in said predetermined direction of pressing;

said support shoe comprising at least two pressure pockets arranged sequentially in said press nip in said predetermined direction of travel of the web;

a common pressure chamber supplied with a suitable pressure medium;

conduits connecting said at least two pressure pockets with said common pressure chamber;

said hydrostatic pressure element comprising a piston movable relative to said pressure chamber and provided with said support shoe;

said pressure pockets defining a total pressure area coming into contact with the web;

said piston having a central axis; and said piston being arranged unsymmetrically in relation to said support shoe such that a first portion of said total pressure area coming into contact with the web and lying before said central axis, as seen in said predetermined direction of travel of the web is greater than a second portion of said total pressure area coming into contact with the web and lying behind said central axis as seen in said predetermined direction of travel of the web.

2. The wet press as defined in claim 1, wherein:

said at least two pressure pockets have effective pressure areas; and said effective pressure areas decreasing in said predetermined direction of travel of the web.

3. The wet press as defined in claim 2, wherein:

said conduits have cross-sectional areas; and said cross-sectional areas increasing in said predetermined direction of travel of the web.

4. The wet press as defined in claim 3, wherein:

said press nip has a press nip height;

said piston arranged unsymmetrically defining an unsymmetrical arrangement of said piston in relation to said support shoe;

said decreasing effective pressure areas of the pressure pockets defining a ratio of effective pressure areas of said pressure pockets arranged sequentially in said predetermined direction of travel of the web;

said increasing cross-sectional areas of the conduits defining a ratio of cross-sectional areas of said conduits connecting said pressure pockets with said common pressure chamber; and said unsymmetrical arrangement, said ratio of effective pressure areas and said ratio of cross-sectional areas being so interrelated that said press nip height is approximately constant as seen in said predetermined direction of travel of the web.

5. The wet press as defined in claim 4, wherein:

said pressure pockets have a resultant pressing force; and said unsymmetrical arrangement and said ratio of effective pressure areas being so interrelated that said resultant pressing force is effective at least approximately at said central axis.

6. The wet press as defined in claim 3, wherein:

the web of material is a fibre web having said predetermined direction of travel;

said support shoe of said hydrostatic pressure element comprising more than two pressure pockets in said predetermined direction of travel of said fibre web;

said pressure pockets having total effective pressure cross-sectional areas;

said total effective pressure cross-sectional areas decreasing in said predetermined direction of said fibre web; and said cross-sectional areas of said conduits increasing in said predetermined direction of travel of the web.

7. The wet press as defined in claim 3, wherein:

the web of material is a fibre web having said predetermined direction of travel;

said support shoe of said hydrostatic pressure element comprising more than two pressure pockets in said predetermined direction of travel of said fibre web; and said cross-sectional areas of said conduits increasing in said predetermined direction of travel of said fibre web.

8. The wet press as defined in claim 3, wherein:

the web of material is a fibre web having said predetermined direction of travel;

said support shoe of said hydrostatic pressure element comprising more than two pressure pockets in said predetermined direction of travel of said fibre web;

said pressure pockets having total effective pressure cross-sectional areas; and said total effective pressure cross-sectional areas decreasing in said predetermined direction of travel of said fibre web.

9. The wet press as defined in claim 1, wherein:

said hydrostatic pressure element comprises a plurality of rows of pressure pockets arranged sequentially in said predetermined direction of travel of the web; and each row of said plurality of rows comprising a plurality of pressure pockets arranged adjacent to one another in a direction extending substantially transverse to said predetermined direction of travel of the web.

10. The wet press as defined in claim 9, wherein:

said hydrostatic pressure element comprises at least one said piston;

said at least one piston supporting at least one said movable support shoe;

said common pressure chamber comprising a stationary pressure chamber; and said at least one piston being movable in said stationary pressure chamber.

11. The wet press as defined in claim 9, wherein:

said hydrostatic pressure element comprises a plurality of said pistons;

said plurality of pistons commonly supporting said at least one movable support shoe; and a plurality of said pressure pockets from a plurality of said rows of pressure pockets being associated with each piston of said plurality of pistons.

12. The wet press as defined in claim 1, further including:

a pressure medium drain device arranged between said at least two pressure pockets in said predetermined direction of travel of the web.

13. A wet press for dewatering a web of material, comprising:

a rotatable roll having a circumference;

a contact pressure device;

said contact pressure device and said rotatable roll defining a press nip therebetween;

at least one water-absorbent belt;

the web of material being guided conjointly with said at least one water-absorbent belt between said contact pressure device and said rotatable roll through said press nip and along a portion of said circumference of said rotatable roll;

the web of material having a predetermined direction of travel;

said contact pressure device comprising a hydrostatic pressure element having a predetermined direction of pressing;

said hydrostatic pressure element comprising a support shoe movable in said predetermined direction of pressing;

said support shoe comprising at least two pressure pockets arranged sequentially in said press nip in said predetermined direction of travel of the web;

a common pressure chamber supplied with a suitable pressure medium;

conduits connecting said at least two pressure pockets with said common pressure chamber;

said hydrostatic pressure element comprising a piston movable relative to said pressure chamber and provided with said support shoe;

said pressure pockets defining a total pressure area coming into contact with the web;

said piston having a central axis;

said piston being arranged unsymmetrically in relation to said support shoe such that a first portion of said total pressure area coming into contact with the web and lying before said central axis, as seen in said predetermined direction of travel of the web is greater than a second portion of said total pressure area coming into contact with the web and lying behind said central axis as seen in said predetermined direction of travel of the web;

said contact pressure device comprising a plurality of said hydrostatic pressure elements arranged adjacent to one another in a direction extending substantially transverse to said predetermined direction of travel of the web;

individual pressure elements of said plurality of pressure elements defining gaps therebetween; and said gaps extending in a direction extending at an acute angle with respect to said predetermined direction of travel of the web.

* * * * *

UNITED STATES PATENT AND TRADEMARK OFFICE

CERTIFICATE OF CORRECTION

PATENT NO. : 4,661,206

DATED : April 28, 1987

INVENTOR(S) : Peter Heitmann et al

It is certified that error appears in the above-identified patent and that said Letters Patent is hereby corrected as shown below:

Title page [*] Notice:, please delete entire paragraph

Column 3, line 5, after "web" please insert --and--

Column 3, line 9, before "which" please insert --and--

Column 7, line 1, please delete "11 elements" and insert --elements 11--

Signed and Sealed this

Tenth Day of November, 1987

*Attest:*

*Attesting Officer*

DONALD J. QUIGG

*Commissioner of Patents and Trademarks*